United States Patent [19]

Koblick

[11] 4,004,355

[45] Jan. 25, 1977

[54] SHOE DEVICE AND METHOD OF ATTACHING A STRAP TO A SHOE MEMBER

[75] Inventor: Jeffrey M. Koblick, Hopkins, Minn.

[73] Assignee: K-tel International, Inc., Minnetonka, Minn.

[22] Filed: May 20, 1976

[21] Appl. No.: 688,416

[52] U.S. Cl. ..... 36/122

[51] Int. Cl.[2] ..... A43B 5/04

[58] Field of Search ..... 36/122, 124, 50

[56] References Cited

UNITED STATES PATENTS

| | | | |
|---|---|---|---|
| 405,516 | 6/1889 | Watson | 36/122 |
| 3,600,829 | 8/1971 | La Violette | 36/142 |

*Primary Examiner*—Patrick D. Lawson

*Attorney, Agent, or Firm*—Allegretti, Newitt, Witcoff & McAndrews

[57] ABSTRACT

A shoe device, such as a toy snow shoe, and a method of attaching a single continuous strap to a shoe member are disclosed. The shoe device includes a shoe member and a strap to a shoe member, attached in accordance with the method, so as to define a pair of retaining loops. By adjusting the size of the loops, the shoe device may be easily secured to a foot or conventional shoe.

7 Claims, 5 Drawing Figures

Fig. 1
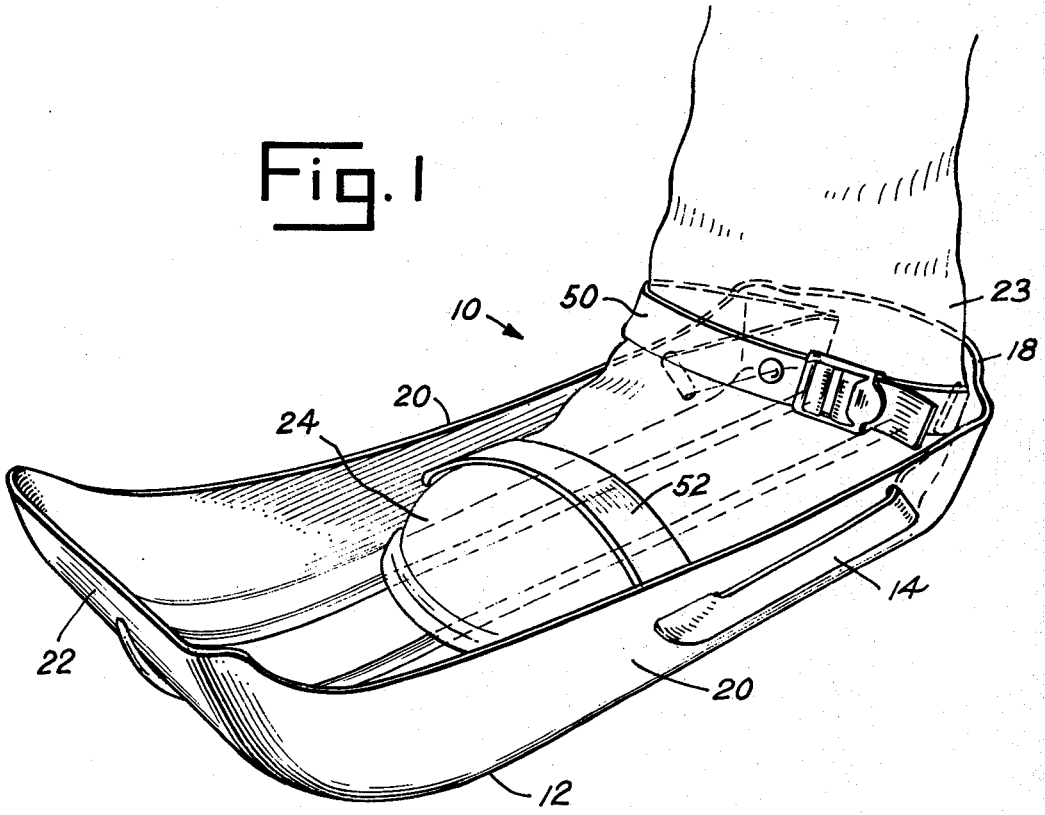
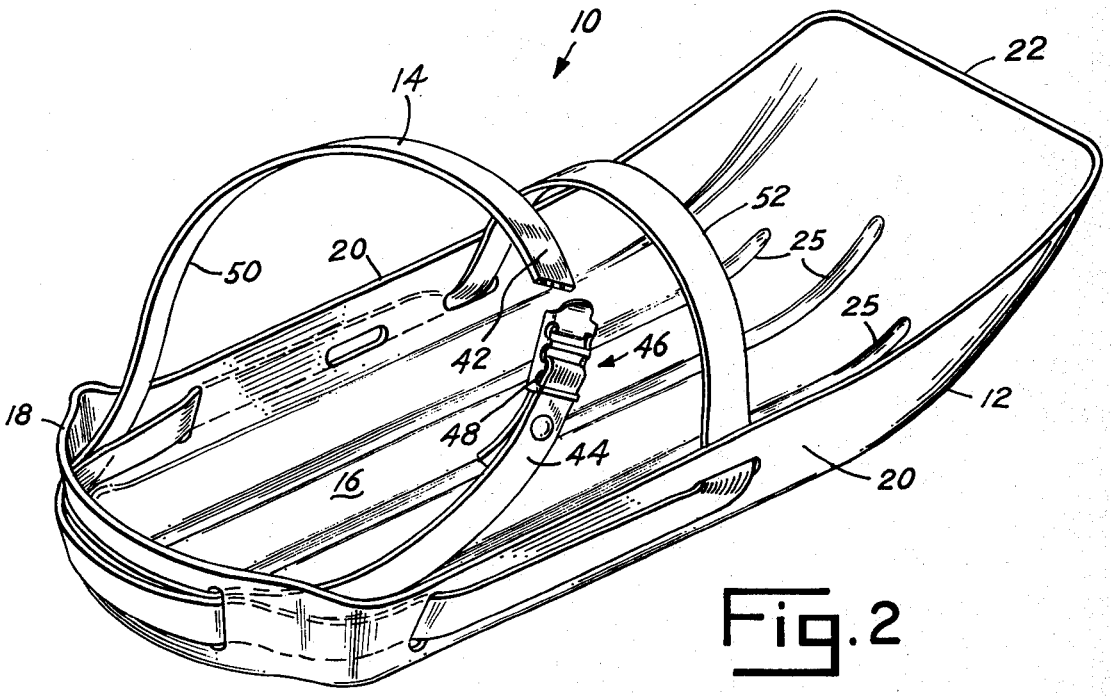
Fig. 2

SHOE DEVICE AND METHOD OF ATTACHING A STRAP TO A SHOE MEMBER

BACKGROUND OF THE INVENTION

The present invention relates to a shoe device, including a shoe member and single continuous strap, and method for attaching the strap to the shoe member so as to facilitate securement of the shoe device to a foot.

Various types of shoe devices, such as snow shoes, are retained on the foot by adjustable straps. Generally two straps are required. The first strap passes around the ankle, and the second passes over to the toe region.

With respect to inexpensive toy devices, such as toy snow shoes, the requirement of a second separate retaining strap substantially increases the cost of the device. The manufacturing process is also complicated as each strap must be secured to the shoe device.

SUMMARY OF THE INVENTION

In a principal aspect, the present invention is a shoe device including a shoe member and single continuous retaining strap. As used herein, the term "shoe member" is broadly defined to include footwear of any type which is attached to the foot or a conventional shoe. For example, and without limitation, shoe member includes a ski and snow shoe.

The shoe member defines a first and second heel slot, at least a first and second toe slot, and a first and second intermediate slot. The retaining strap passes appropriately through the slots to define a toe-retaining loop and ankle-retaining loop.

In another aspect, the present invention is a method of attaching a strap to a shoe member having at least three pair of corresponding slots. The method includes passage of the strap inwardly and outwardly through the slots with respect to the shoe member, such that the strap defines a pair of retaining loops for securing the shoe member to a foot or conventional shoe.

It is thus an object of the present invention to provide a shoe device, having a single continuous strap, which is securable to a foot or conventional shoe.

It is also an object of the present invention to provide a method of attaching a single strap to a shoe member, such that the shoe member is securable to a foot or conventional shoe without additional straps.

It is another object of the present invention to provide a toy snow shoe having a single continuous retaining strap that may be utilized to quickly and easily secure the toy snow shoe to a foot.

It is a further object of the present invention to provide an inexpensively and readily manufactured toy snow shoe requiring only a single retaining strap.

These and other objects, features and advantages of the present invention are disclosed in the following detailed description.

BRIEF DESCRIPTION OF THE DRAWING

A preferred embodiment of the present invention is described, in detail, with reference to the drawing wherein:

FIG. 1 is a plan view of a preferred embodiment of the present invention, shown secured to the foot of a user;

FIG. 2 is a rear plan view of the preferred embodiment shown in FIG. 1;

DESCRIPTION OF THE PREFERRED EMBODIMENT

Figure 3:
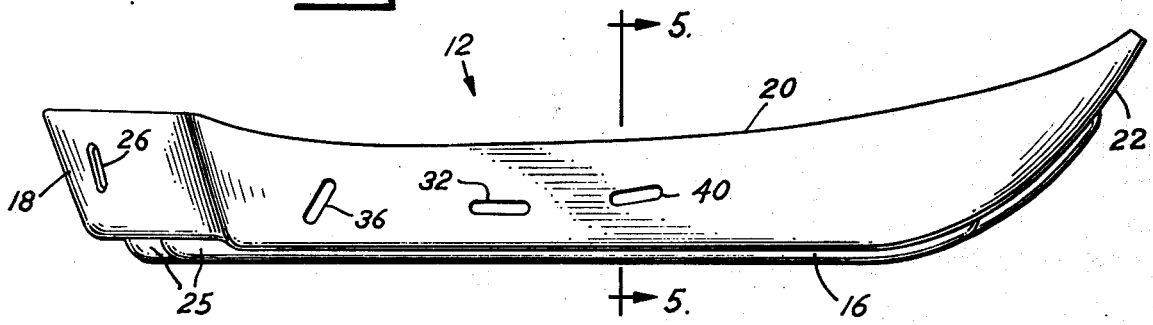
FIG. 3 is a side view of the preferred embodiment shown in FIG. 2 without the retaining strap.

Referring to FIGS. 1–5, a preferred embodiment of the present invention is shown as a shoe device 10. The shoe device 10 includes a shoe member 12 and retaining strap 14. In this preferred embodiment, the shoe member 12 is a toy snow shoe.

The snow shoe 12 is preferably a single-piece construction of plastic material, such as polyethylene. The snow shoe 12 has a substantially planar foot supporting base 16, a curved rear wall 18, substantially planar side walls 20 and an upwardly curved front wall 22. The curved rear 18 is adapted to engagingly receive to heel portion 23 of a conventional shoe or boot 24.

The snow shoe 12 also includes a series of ribs 25, extending substantially longitudinally along the bottom of the foot-supporting base 16 and front wall 22. In the snow, the ribs 25 substantially decrease frinctional resistance to sliding and operate as guides to assist the user in maintaining a straight course.

Figure 4:
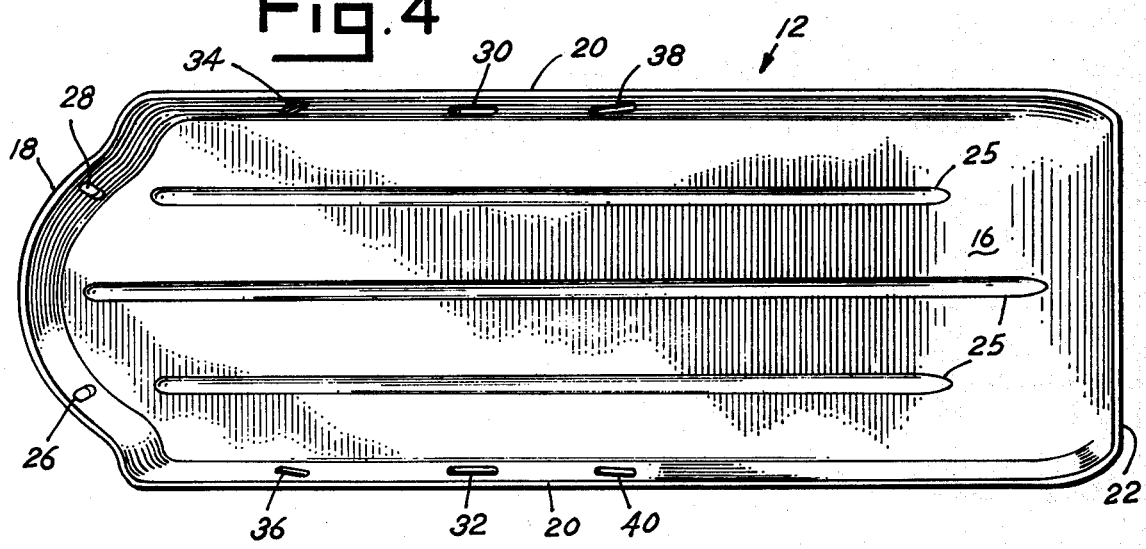
FIG. 4 is a top view of the preferred embodiment shown in FIG. 3.
Figure 5:
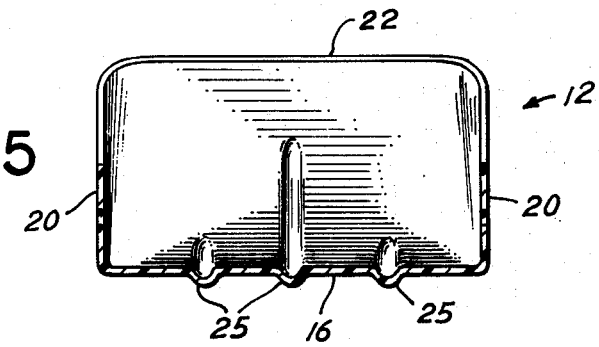
FIG. 5 is a cross-sectional view of the preferred embodiment shown in FIG. 3 taken along 5 — 5.

As best shown in FIGS. 3 and 4, the snow shoe 12 defines a first and second heel slot 26, 28 in the rear wall 18, at least a first and second toe slot 30, 32 in the side walls 20, and a first and second intermediate slot 34, 36 in the side walls 20. The intermediate slots 34, 36 interpose the toe slots 30, 32 and heel slots 26, 28, respectively.

In this preferred embodiment of the present invention, the snow shoe 12 also defines a second pair of toe slots 38, 40. With respect to the first and second toe slots 30, 32, the third and fourth toe slots 38, 40 are displaced towards the front wall 22. As more fully described below, the first and second pair of toe slots 30, 32 and 38, 40 permit the shoe device 10 to be appropriately sized.

Referring to FIG. 4, the snow shoe 12 is substantially symmetrical about a longitudinal axis represented by the middle rib 25. The heel slots 26, 28, toe slots 30, 32 and 38, 40, and intermediate slots 34, 36 substantially align along respective axes perpendicular thereto.

The retaining strap 14 is preferably a nylon, polypropylene or polyethylene strap. The retaining strap 14 includes a first and second end portion 42, 44 and means 46 for securing the first and second end portions 42, 44 together. In this preferred embodiment, the securing means 46 is a buckle 48 rigidly affixed to the second end portion 44 of the retaining strap 14. The first end portion 42 is adjustably securable to the buckle 48.

The retaining strap 14 is attached to the snow shoe 12 by initially passing the first end portion 42 of the strap 14 outwardly through the first heel slot 26 and inwardly through the second heel slot 28. As used herein, the terms "inwardly", and "outwardly" and obvious derivatives thereof refer and relate to the snow show 12. Inwardly means towards the interior of the snow shoe 12 and outwardly means away therefrom.

The first end portion 42 of the retaining strap 14 is then passed outwardly through the first intermediate slot 34, inwardly through either the first or third toe slot 30, 38, outwardly through either the second or fourth toe slot 32, 40, inwardly through the second intermediate slot 36, outwardly through the first heel slot 26 and inwardly through the second heel slot 28. As shown, at least a segment of the second end portion 44 is maintained inwardly of the first heel slot 26.

Attached in this fashion, the retaining strap 14 defines an ankle-retaining loop 50 and toe-retaining loop 52. The position of the toe-retaining loop 52 is determined by the pair of toe slots 32, 34 or 38, 40 selected. As such, the shoe device 10 can be adjusted to fit the user.

By means of the buckle 48, the ankle-retaining loop 50 and toe-retaining loop 52 are adjustable, such that the shoe device 10 is readily securable to the user's foot or shoe without additional straps of any type. That is, the shoe device 10 substantially eliminates the expensive second strap required by other devices of this type.

The method of securing the single continuous strap 14 to the shoe member 12 need not be described separately, as adequately set forth in the description of the shoe device 10. It is to be understood, however, that at least a segment of the second end portion 44 of the strap 14 must be maintained inwardly of the first heel slot 28 for attachment to the first end portion 42 thereof.

Embodiments of the present invention have been disclosed and described herein. It is to be understood, however, that various changes and modifications can be made without departing from the true scope and spirit of the present invention, as set forth and defined in the following claims.

What is claimed is:

1. A shoe device comprising, in combination:

a shoe member having a first and second heel slot, at least a first and second toe slot, and a first and second intermediate slot;

a single continuous retaining strap passing outwardly through said first heel slot, inwardly through said second heel slot, outwardly through said first intermediate slot, inwardly through said first toe slot, outwardly through said second toe slot, inwardly through said second intermediate slot, outwardly through said first heel slot and inwardly through said second heel slot to define a first and second end portion and a toe-retaining loop; and means for securing said first and second end portions of said single continuous retaining strap to define an ankle-retaining loop.

2. A shoe device as claimed in claim 1 wherein said securing means is adjustable, such that the size of said toe-retaining and ankle-retaining loops is adjustable.

3. A shoe device as claimed in claim 2 wherein said shoe member is a snow shoe having a rear wall and side walls.

4. A shoe device as claimed in claim 3 wherein said rear wall includes said first and second heel slots and said side walls include said first and second toe slots and said first and second intermediate slots.

5. A shoe device as claimed in claim 2 wherein said shoe member has a third and fourth toe slot displaced from said first and second toe slots, whereby the position of said toe-retaining loop is adjustable.

6. A method of securing a single continuous strap to a shoe member to provide a pair of retaining loops, said strap having a first and second end portion, said shoe member having a first and second heel slot, at least a first and second toe slot, and a first and second intermediate slot, comprising the steps of:

passing said first end portion outwardly through said first heel slot, inwardly through said second heel slot, outwardly through said first intermediate slot, inwardly through said first toe slot, outwardly through said second toe slot, inwardly through said second intermediate slot, outwardly through said first heel slot and inwardly through said second heel slot to define a toe-retaining loop between said first and second toe slots; and securing said first and second end portions of said single continuous retaining strap to define an ankle-retaining loop.

7. A method as claimed in claim 7 wherein said first and second end portions of said strap are adjustably secured.

* * * * *